US006403902B1

(12) United States Patent
Castonguay et al.

(10) Patent No.: US 6,403,902 B1
(45) **Date of Patent: *Jun. 11, 2002**

(54) CIRCUIT BREAKER BELL ALARM ACCESSORY HAVING OPTIONAL RESET AND LOCKOUT FUNCTION

(75) Inventors: Roger N. Castonguay, Terryville; Dean A Robarge, Southington, both of CT (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 18 days.

This patent is subject to a terminal disclaimer.

(21) Appl. No.: 09/006,792

(22) Filed: Jan. 14, 1998

Related U.S. Application Data

(63) Continuation-in-part of application No. 08/908,767, filed on Aug. 8, 1997, now Pat. No. 5,960,941.

(51) Int. Cl.[7] ..... H01H 73/12
(52) U.S. Cl. ..... 200/308; 200/323
(58) Field of Search ..... 200/308, 323; 340/638, 644

(56) References Cited

U.S. PATENT DOCUMENTS

| | | | |
|---|---|---|---|
| 3,084,238 A | 4/1963 | Baskerville | |
| 3,095,489 A | 6/1963 | Baird | |
| 4,672,501 A | 6/1987 | Bilac et al. | 361/96 |
| 5,502,286 A | 3/1996 | Pollman et al. | 200/401 |

*Primary Examiner*—Renee Luebke
(74) *Attorney, Agent, or Firm*—Cantor Colburn LLP

(57) ABSTRACT

A combination air circuit breaker bell alarm reset and lock-out accessory unit interacts with the circuit breaker closing system to prevent charging of the circuit breaker closing spring until and unless the bell alarm module has been manually reset in one option and allows automatic reset of the bell alarm module prior to charging of the closing spring in a further option. The orientation of the bell alarm module on the combination reset and lock-out accessory unit support plate determines the reset or lock-out option selection.

19 Claims, 5 Drawing Sheets

CIRCUIT BREAKER BELL ALARM ACCESSORY HAVING OPTIONAL RESET AND LOCKOUT FUNCTION

CROSS REFERENCE TO RELATED APPLICATION

This application is a continuation-in-part of U.S. Application Ser. No. 08/908,767, filed Aug. 8, 1997, which is now U.S. Pat. No. 5,960,941.

BACKGROUND OF THE INVENTION

Air circuit breakers, as described within U.S. Pat. No. 3,095,489 entitled "Manual Charging Means for Stored Energy Closing Mechanisms of Electric Circuit Breakers" and U.S. Pat. No. 3,084,238 entitled "Ratchet Mechanism for Charging a Closing Spring in an Electric Circuit Breaker", include operating mechanisms that are mainly exposed to the environment. Since the air circuit breakers are rated to carry up to several thousand amperes of current continuously, the exposure to convection cooling air assists in keeping the operating components within reasonable temperature limits.

Various accessory devices are used with such air circuit breakers to provide auxiliary function along with overcurrent protection. One such accessory is the bell alarm accessory that provides local and remote indication as to the occurrence of circuit interruption. U.S. Pat. No. 5,502,286 entitled "Bell Alarm and Lock-Out for High Ampere-Rated Circuit Breakers" describes a bell alarm accessory used with so-called "insulated case" circuit breakers wherein the circuit breaker interrupting components are completely enclosed within an insulating plastic enclosure.

U.S. Pat. No. 5,986,225 filed on Jun. 19, 1997 entitled "Circuit Breaker Bell Alarm Accessory with Lockout" describes a bell alarm accessory for use with a high ampere-rated air circuit breaker that provides local as well as remote indication of such circuit interruption as well as preventing circuit breaker contact closure until and unless the bell alarm accessory has been manually reset.

High ampere-rated air type circuit breakers operate in the range of 2500 to 5000 amperes such that the large circuit breaker operating components are arranged air type circuit breakers, that operate in the range of 150 to 1500 amperes, require bell alarms with lockout function to prevent contact closure until the bell alarm unit is reset, the arrangement of the circuit breaker smaller operating components do not allow the use of the high ampere-rated bell alarm reset accessory.

U.S. Pat. No. 6,054,661 entitled "Circuit Breaker Bell Alarm Accessory with Lockout Function" filed concurrently with this application describes a low ampere-rated air circuit breaker that includes an arrangement for preventing the circuit breaker contacts from becoming closed until the bell alarm module has become manually reset. U.S. Pat. No. 6,242,703, dated Jun. 5, 2001 B1, entitled "Circuit Breaker Bell Alarm Accessory with Automatic Reset for Small Frame Air Circuit Breaker" filed concurrently with this application further describes an arrangement for automatically resetting the bell alarm accessory within a low ampere-rated air circuit breaker during the early stage of the circuit breaker closing spring charge cycle.

One approach to an arrangement that allows alternative bell alarm automatic reset function reset or bell alarm lock-out function within one accessory apparatus within high ampere-rated air circuit breakers is found in U.S. Pat. No. 5,960,941 filed Aug. 8, 1997 entitled "Circuit Breaker Bell Alarm Accessory with Both Automatic Reset and Lock-out Function".

In view of the size and component design differences between the high ampere-rated and low ampere-rated air circuit breakers described earlier, the high ampere-rated combined bell alarm accessory would not function within low ampere-rated air circuit breaker enclosures. The purpose of the instant invention is to describe an arrangement for allowing selection between bell alarm automatic reset and automatic lock-out function in low ampere-rated air circuit breakers.

SUMMARY OF THE INVENTION

A combination bell alarm lock-out and bell alarm automatic reset accessory unit alternatively interacts with the circuit breaker closing system to prevent charging of the circuit breaker closing spring until and unless the bell alarm module has been manually reset in one option and interacts with the circuit breaker closing system to automatically reset the bell alarm accessory during charging of the circuit breaker closing spring in another option. The combination accessory support plate includes a first aperture to allow the bell alarm lockout plunger to interact with a first part of the closing system for automatic reset and includes a second aperture to allow the bell alarm lockout plunger to interact with a second part of the closing system to prevent closure of the circuit breaker closing spring until the bell alarm accessory is reset. The position of the bell alarm accessory on the accessory support plate determines which of the two apertures within which the lockout plunger becomes inserted.

BRIEF DESCRIPTION OF THE DRAWINGS

FIGS. 4*a* and 4*b* are front perspective views wherein FIG. 4*a* is shown configured for automatic lock-out function and FIG. 4*b* is shown configured for automatic reset function of the combination bell alarm reset and lock-out accessory unit within the air circuit breaker of FIG. 1 with the bell alarm accessory module in isometric projection.

DESCRIPTION OF THE PREFERRED EMBODIMENT

Figure 1:
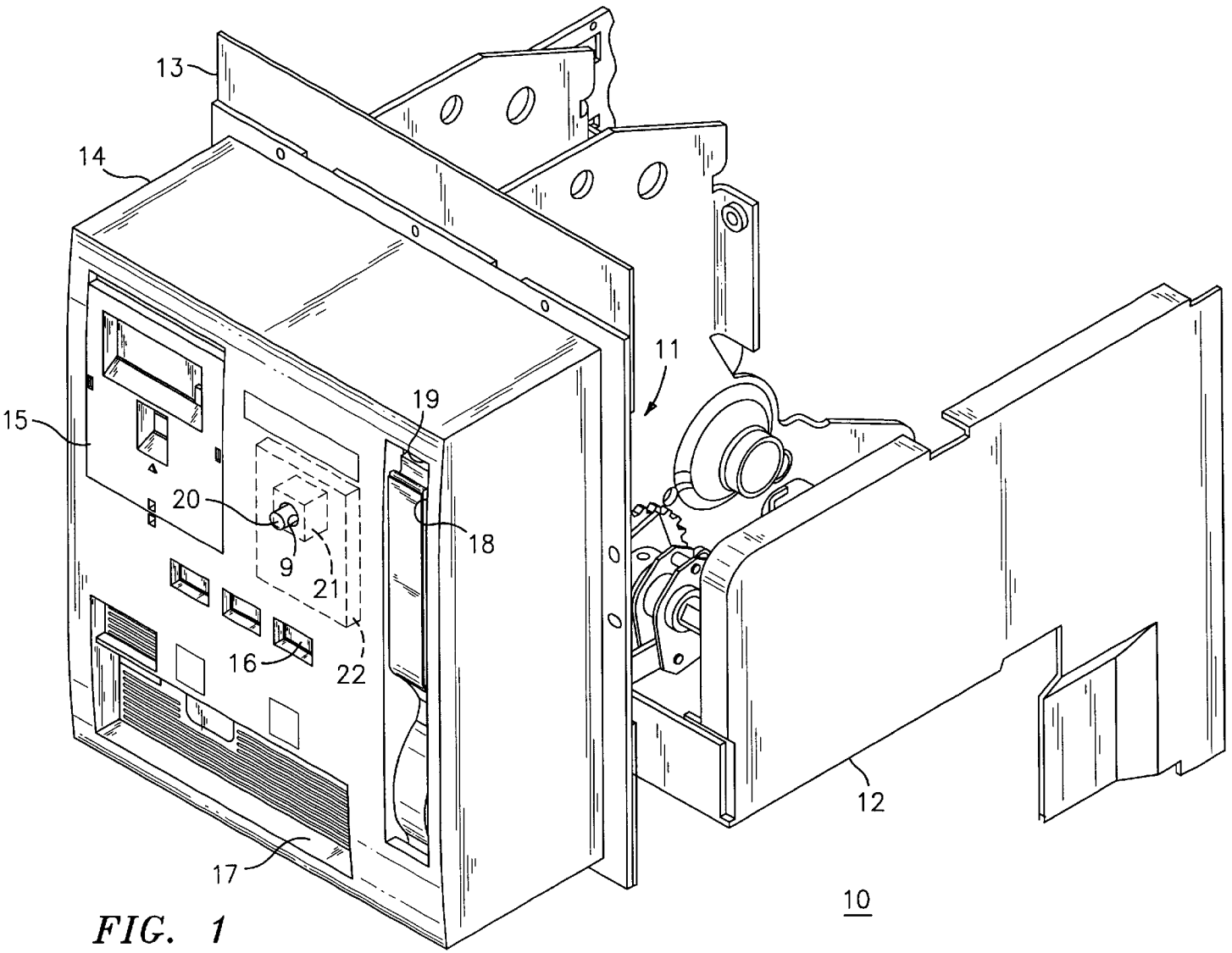
FIG. 1 is top perspective view of an air circuit breaker containing the combined bell alarm automatic reset and automatic lock-out accessory unit attached to a front part of the circuit breaker contact closing assembly in accordance with the invention.

The air circuit breaker 10 of FIG. 1 is shown attached to the circuit breaker cover plate 13 interfacing with the circuit breaker contact closing assembly 11 that is positioned between the circuit breaker operating mechanism sideframes 12. Circuit breaker operating mechanism sideframes 12 are similar to that described within the aforementioned U.S. Pat. No. 3,095,489. The circuit breaker cover 14 supports the trip unit programmer 15. Trip unit programmer 15 is similar to that described in U.S. Pat. No. 4,672,501 entitled "Circuit Breaker and Protective Relay Unit". The circuit breaker cover 14 includes buttons 16 for releasing the circuit breaker contacts (not shown) to their OPEN condition and for moving the contacts to their CLOSED condition. The circuit breaker operating handle 18, positioned within the handle recess 19, allows manual interaction with the contact closing assembly 11 to both open and close the circuit breaker contacts. An accessory such as a bell alarm module 21, which is similar to that described in the aforementioned U.S. Pat. No. 5,502,286, is mounted on a combined bell alarm reset and lock-out unit 22 to provide visual indication of the occurrence of contact separation by means of the pop-up target 20 that extends through the target aperture 9 formed in the circuit breaker cover 14. Other circuit breaker accessories can be inserted within the accessory recess 17, if so desired.

Figure 2:
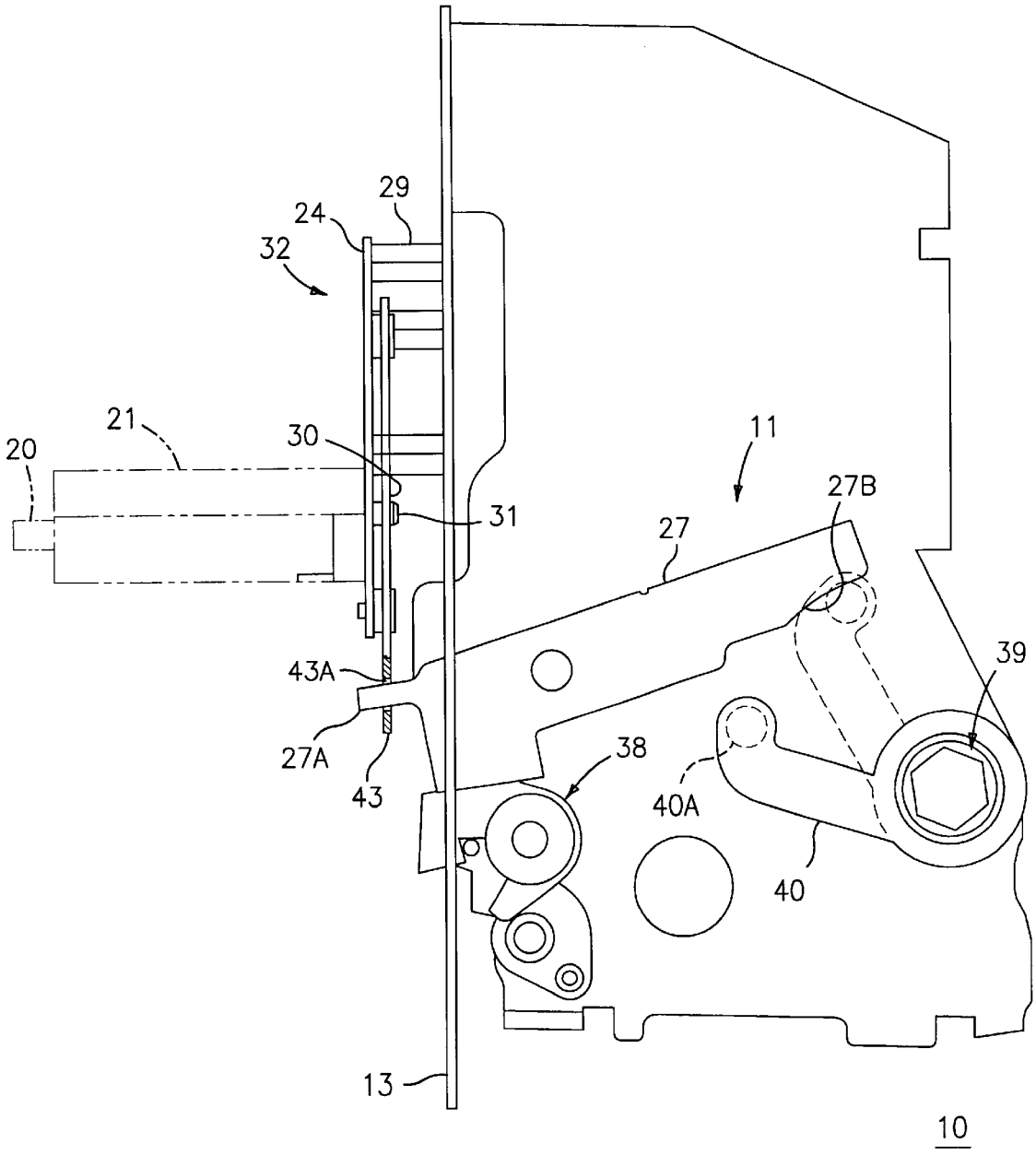
FIG. 2 is an enlarged side plan view of an air circuit breaker an air circuit breaker depicting a bell alarm lock-out accessory unit.

Referring to FIG. 2, circuit breaker 10 illustrates an automatic lock-out facility. Circuit breaker cover 14 (see FIG. 1) is removed from the circuit breaker cover plate 13 to illustrate the position of the bell alarm module 21 on the bell alarm lock-out unit 32. Bell alarm module 21 is arranged on the bell alarm support plate 24 with the bell alarm reset plunger 31 extending through the lock-out aperture 30 formed in the cover plate 13. In the contact CLOSED condition, the bell alarm target 20 is un-extended from the bell alarm module 21 and becomes extended therefrom upon occurrence of contact separation during circuit overload conditions. The bell alarm support plate 24 is fastened to the cover plate 13 by means of mounting studs 29 and the lockout slide 43 is attached to the bottom of the support plate 24 for interaction with the contact closing assembly 11 in the manner described in the aforementioned U.S. Pat. No. 6,054,661. The closing lever 27 is attached to the closing shaft 39 within the closing mechanism described therein interacts with the operational links 38 in the manner described below. The closing lever 27 has a cam surface 27B at one end of the closing lever 27 that interacts with a post 40A on the closing shaft cam 40. A tab 27A is captured within the slot 43A on the lockout slide 43 next to the bell crank assembly at the other end thereof. The purpose of the bell alarm lock-out function is to insure that the bell alarm module 21 is manually reset by depression of the bell alarm target 20 with the corresponding retraction of the plunger 31 from within the lockout aperture 30.

Figure 3:
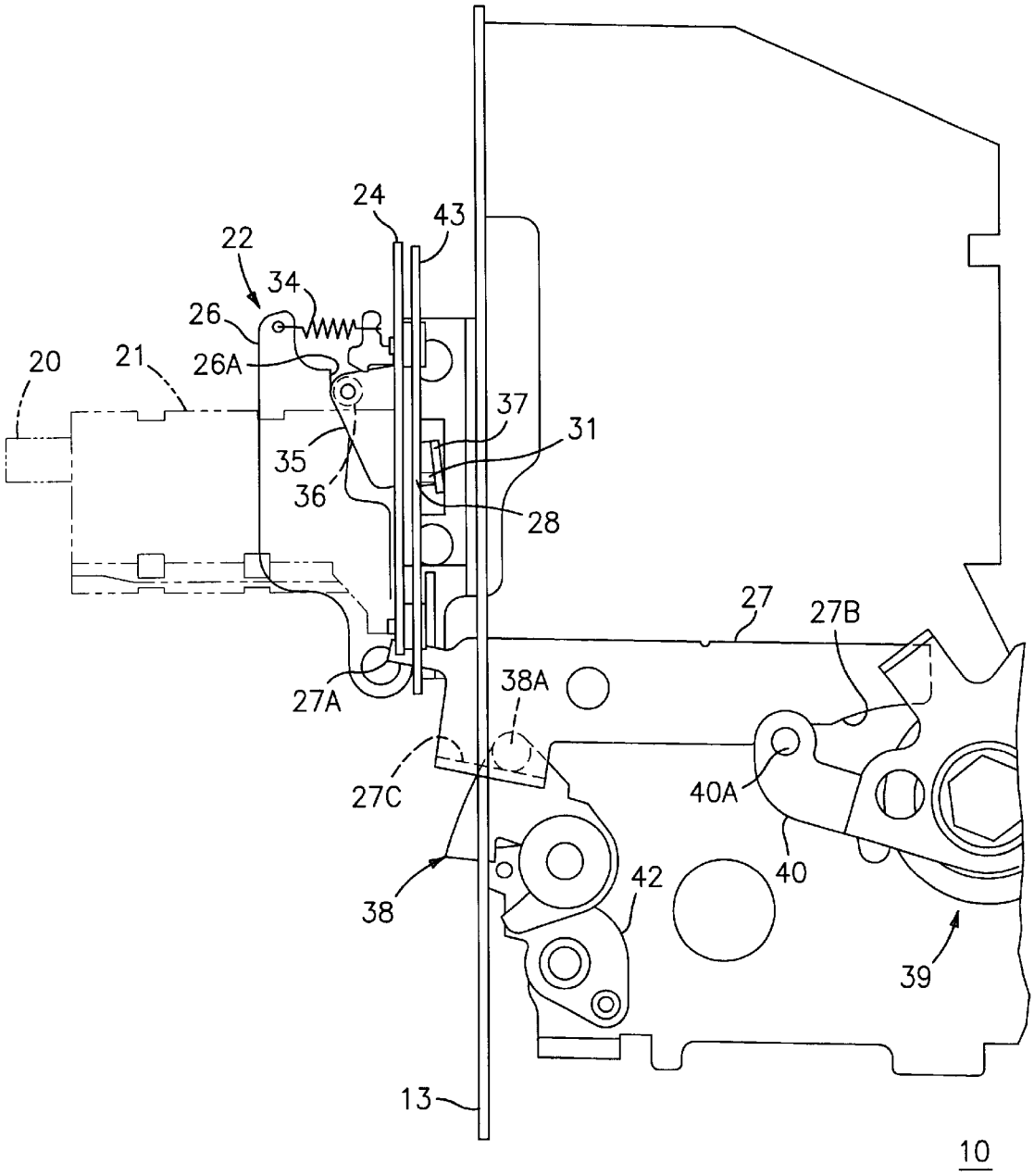
FIG. 3 is an enlarged side plan view of an air circuit breaker depicting a bell alarm automatic reset accessory unit.

Referring to FIG. 3, circuit breaker 10 illustrates an automatic reset facility. Circuit breaker cover 14 (see FIG. 1) is removed from the circuit breaker cover plate 13 to illustrate the position of the bell alarm module 21 on the bell alarm reset unit 22. Bell alarm module 21 is arranged on the bell alarm support plate 24 with the bell alarm reset plunger 31 extending through the reset aperture 28 formed in the cover plate 13. The bell alarm unit 21 is depicted in FIG. 3 with the circuit breaker 10 in the OFF condition such that the pop-up target 20 on the bell alarm module 21, as indicated in phantom, is extended from the top and the lock-out plunger 31 is extended from the bottom thereof through the reset aperture 28 in the manner described within the aforementioned U.S. Pat. No. 6,242,703B1, dated Jun. 5, 2001. The closing lever 27 extending from the closing shaft 39 interacts with the operating link 38 by means of the post 38A extending from the operating link in contact with tab 27C on the end of the closing lever 27. The reset bypass cam 26 interacts with the reset arm 35 by contact between the roller 36 on reset arm 35 and the surface 26A formed on the bottom of the reset bypass cam 26.

When an attempt is made to rotate the closing shaft 39 to charge the circuit breaker closing spring (not shown), tab 27A on the top of the closing lever, captured within the slot 43A (FIG. 2) on the end of the lockout slide 43, allows the reset arm 35 to rotate in unison with the reset bypass cam 26 by virtue of the connection or reset spring 34 whereby the tab 37 on the bottom of the reset arm 35 retracts the lockout plunger 31 from within the reset aperture 28 to allow rotation of the operating link 38 away from the operating link 42 and return the closing shaft 39 to the charged position. In the charged position of the closing shaft 39, the post 40A on the closing shaft cam 40 returns into contact with the cam surface 27B formed on the end of the closing lever 27, as shown earlier in FIG. 2. The purpose of the bell alarm reset function is to allow automatic reset of the bell alarm target 20 by automatic retraction of the plunger 31 from within the reset aperture 28.

Figure 4A:
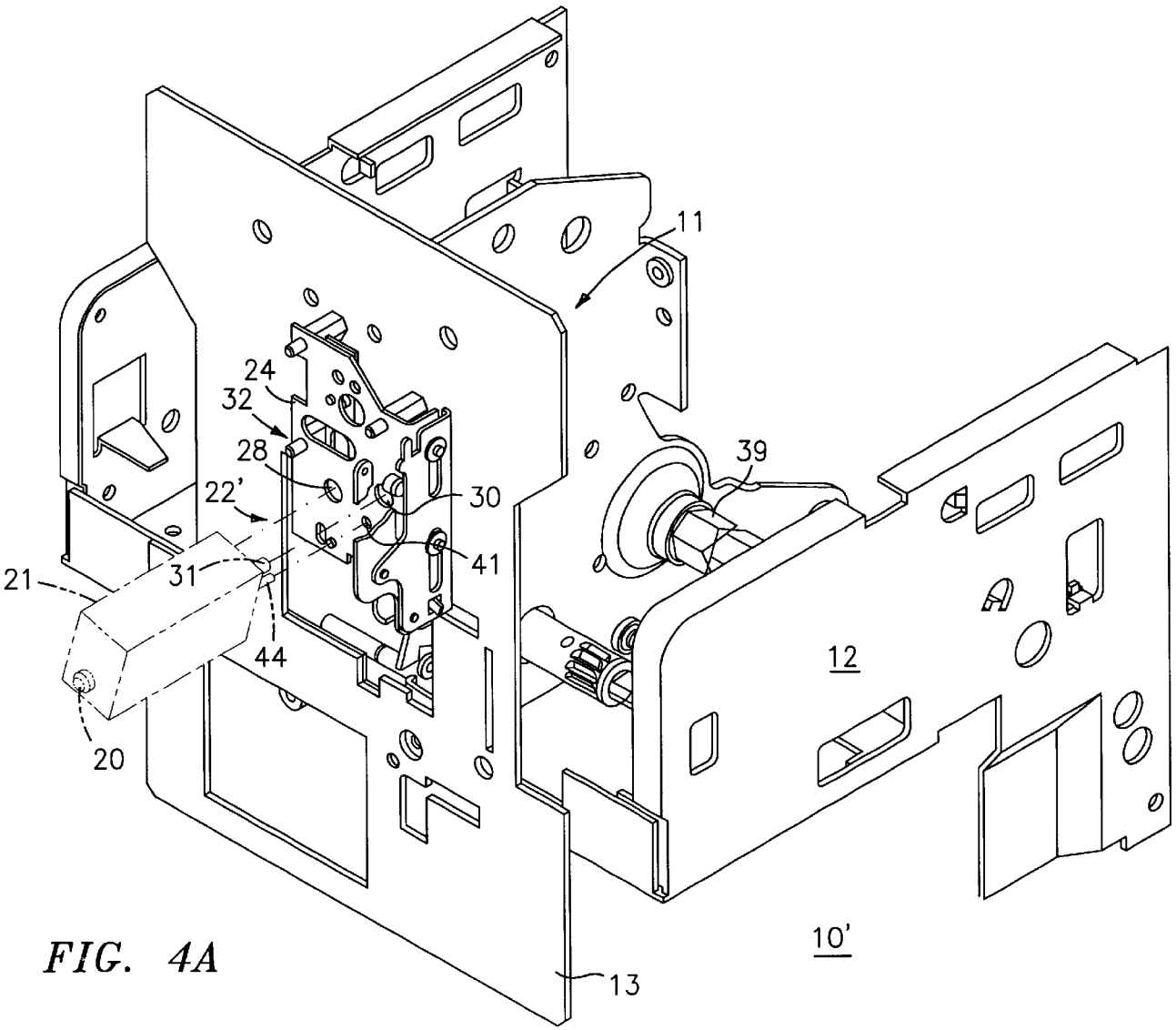
Figure 4B:
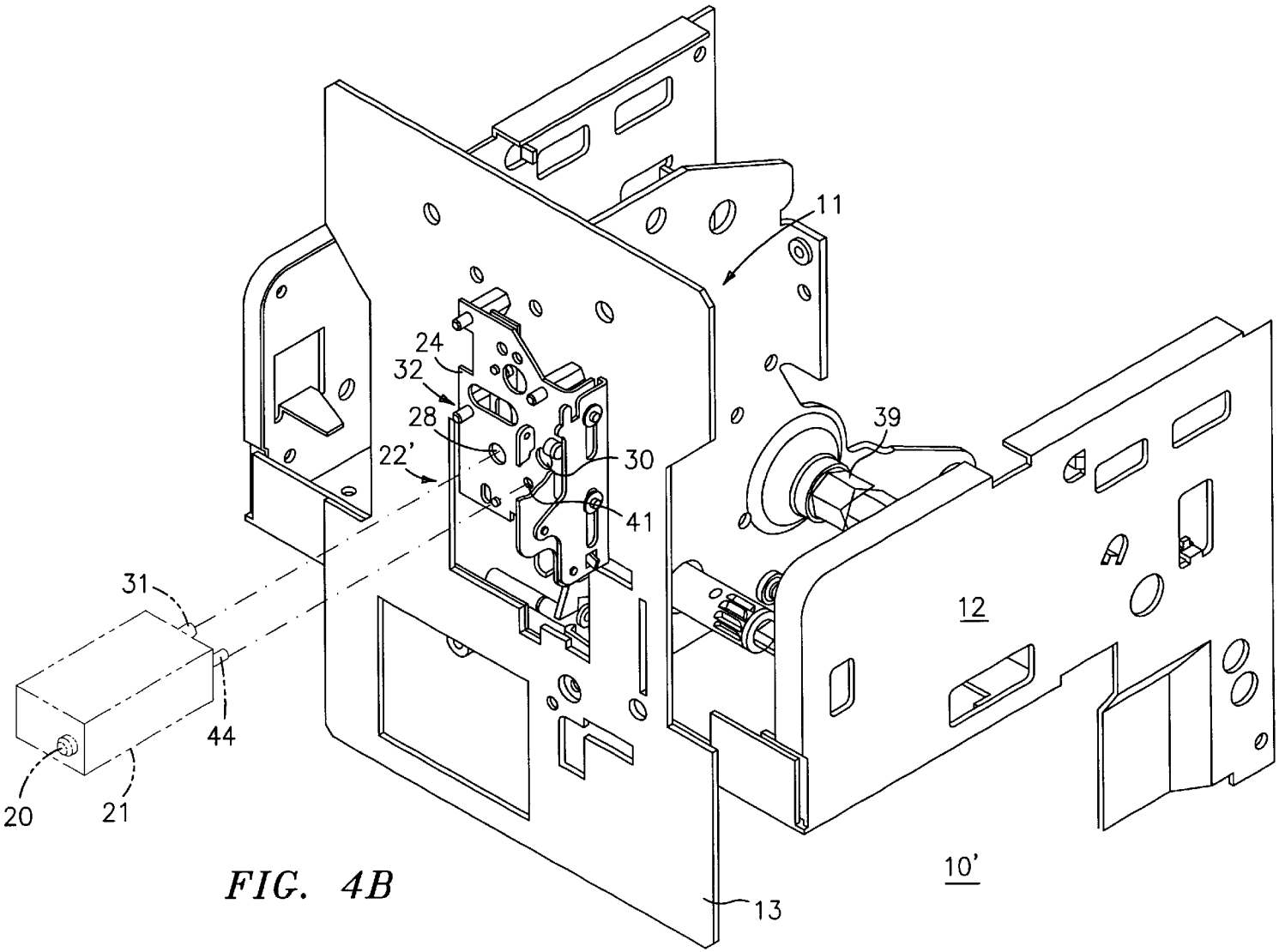

FIGS. 4A and 4B illustrate the selection between automatic lock-out and automatic reset function within a low ampere-rated circuit breaker 10'. The combined bell alarm reset and lockout assembly (hereinafter "combined assembly 22'") is attached onto the circuit breaker cover plate 13. The closing shaft 39 operates within the contact closing assembly 11 between the operating mechanism sideframes 12 relative to the combined assembly 22' in the same manner described earlier with respect to FIGS. 2 and 3 to provide the bell alarm lock-out and reset functions with the lock-out assembly 32 and the reset assembly 22 attached to a common support plate 24. In accordance with the teachings of the invention, a separate pair of apertures such as the reset aperture 28 and the lock-out aperture 30 are formed within the common support plate 24.

The bell alarm module 21 is depicted in phantom in two different positions prior to attaching to the combined assembly 22' to illustrate the reset and lock-out function options. To insure that the pop-up target 20 is positioned accurately with respect to the bell alarm target aperture 9, shown within the circuit breaker cover 14, of FIG. 1, the alignment pin 44, on the bottom of the bell alarm module 21 is therefor received in a common alignment aperture 41. To facilitate automatic lock-out function, the plunger 31 in the bell alarm module 21 is inserted within the lock-out aperture 30, as indicated. To facilitate automatic reset function, the plunger 31 in the bell alarm module 21 is inserted within the reset aperture 28. If the reset bell alarm function is later required, the bell alarm module 31 is removed from the support plate 24 such that the plunger 31 is extracted from the lock-out aperture 30 and the same module is rotated to position the plunger within the reset aperture 28 so that such reset function is then automatically attained. It is shown that either lock-out function or reset function can be factory as well as field selected by simply removing the bell alarm module and rotating the module about the alignment pin 44 depending on the desired function.

An arrangement for bell alarm accessory function within low ampere-rated air circuit breakers has herein been described, whereby a combined assembly is adapted for receiving a common bell alarm module and the rotational position of the bell alarm module selects either a lock-out function or a reset function.

What is claimed is:

1. A combined bell alarm lock-out and reset assembly for a circuit breaker comprising:

a support platform including a plate having a reset aperture arranged on one part of said platform and a lock-out aperture on another part of said platform; wherein said support platform is adapted to support a bell alarm module in a first and second position such that when said bell alarm module is in said first position, a bell alarm plunger on a bottom of said bell alarm module is received in said reset aperture and when said bell alarm module is in said second position, said bell alarm plunger is received in said lock-out aperture and wherein when installed on said circuit breaker and said bell alarm plunger is in said reset aperture, said assembly is configured to automatically reset when a closing spring in said circuit breaker is recharged; when installed on a circuit breaker and said bell alarm plunger is in said lock-out aperture, said assembly is configured to prevent said circuit breaker closing spring from being recharged until said assembly is manually reset.

2. The combined bell alarm lock-out and reset assembly of claim 1 including a reset assembly mounted to a bottom of said support platform interacting with said bell alarm plunger when said circuit breaker has become discharged.

3. The combined bell alarm lock-out and reset assembly of claim 2 further comprising a drive slot formed on one end of a lockout slide in said reset assembly, said drive slot being arranged for receiving a tab formed at one end of a circuit breaker closing spring operating link, said lockout slide causing said bell alarm plunger to reset upon movement of the circuit breaker closing spring operating link when said circuit breaker closing spring is recharged.

4. The combined bell alarm lock-out and reset assembly of claim 1 including a lockout assembly mounted to a bottom of said support platform interacting with said bell alarm plunger when a circuit breaker has become discharged.

5. The combined bell alarm lock-out and reset assembly of claim 4 whereby depression of a pop-up target on top of said bell alarm module causes said bell alarm plunger to retract from within said lock-out aperture, allowing rotation of a circuit breaker closing spring operating link of said circuit breaker.

6. The combined bell alarm lock-out and reset assembly of claim 4 further comprising a reset cam and a reset arm attached to said reset cam by a reset spring, said reset cam defining a camming surface in contact with a roller extending from said reset arm.

7. The combined bell alarm lock-out and reset assembly of claim 6 further comprising a reset tab formed on said reset arm, said reset tab being arranged for interacting with an end of said bell alarm plunger to move said bell alarm plunger out from said reset aperture.

8. The combined bell alarm lock-out and reset assembly of claim 4 wherein said support platform further includes an alignment pin aperture for receiving an alignment pin extending from said bottom of said bell alarm module.

9. The combined bell alarm lock-out and reset assembly of claim 1 wherein said support platform is adapted to attach to a circuit breaker operating mechanism enclosure of said circuit breaker.

10. The combined bell alarm lock-out and reset assembly of claim 1 wherein said support platform includes stand-off connectors adapted to attach to a circuit breaker operating mechanism enclosure of said circuit breaker.

11. The combined bell alarm lock-out and reset assembly of claim 1 wherein said plate further comprises an alignment aperture arranged on a third part of said platform for receiving an alignment pin extending from the bottom of said bell alarm module when said assembly is in at least one of said first and second positions.

12. A circuit breaker comprising:

an enclosure;

a circuit breaker closing spring for operating movable contacts within said enclosure;

a bell alarm assembly on said enclosure, said bell alarm assembly including a support platform and a bell alarm module; said bell alarm module having a pop-up target on a top thereof for indicating occurrence of contact separation within said enclosure of said circuit breaker and a plunger on a bottom thereof for interacting with said support platform, said support platform including a support plate having a reset aperture arranged on one part of said support plate and a lock-out aperture on another part of said support plate; wherein said support platform is adapted to support said bell alarm module in a first and second position such that when said bell alarm module is in said first position, said bell alarm plunger is received in said reset aperture and when said bell alarm module is in said second position, said bell alarm plunger is received in said lock-out aperture and wherein when said bell alarm plunger is in said reset aperture, said assembly is configured to automatically reset when said closing spring is recharged; and when said bell alarm plunger is in said lock-out aperture, said assembly is configured to prevent said circuit breaker closing spring from being recharged until said assembly is manually reset.

13. The circuit breaker of claim 12 including a reset assembly mounted to a bottom of said support plate interacting with said bell alarm plunger when said circuit breaker has become discharged.

14. The circuit breaker of claim 13 wherein said reset assembly includes a reset cam and a reset arm attached to said reset cam by a reset spring, said reset cam defining a camming surface in contact with a roller extending from said reset arm.

15. The circuit breaker of claim 14 wherein said reset assembly further includes a reset tab formed on said reset arm, said reset tab being arranged for interacting with an end of said plunger to move said plunger out from said aperture.

16. The circuit breaker of claim 13 further comprising a drive slot formed on one end of a lockout slide in said reset assembly, said drive slot being arranged for receiving a tab formed at one end of a circuit breaker closing spring operating link, said lockout slide causing said bell alarm plunger to reset upon movement of the circuit breaker closing spring operating link when said circuit breaker closing spring is recharged.

17. The circuit breaker of claim 16 wherein said bell alarm plunger retracts from within said lock-out aperture allowing rotation of said circuit breaker closing spring operating link for charging said circuit breaker when said pop-up target on top of said bell alarm module is depressed.

18. The circuit breaker of claim 12 wherein said support plate is attached to said enclosure by means of stand-off connectors.

19. The circuit breaker of claim 12 wherein said support plate further includes an alignment pin aperture for receiving an alignment pin extending from the bottom of said bell alarm module for orientating said pop-up target relative to a circuit breaker enclosure cover.

* * * * *